US010734011B2

(12) United States Patent
Gether et al.

(10) Patent No.: US 10,734,011 B2
(45) Date of Patent: Aug. 4, 2020

(54) METHOD AND SYSTEM FOR TRANSMISSION PATH NOISE CONTROL

(71) Applicant: ams AG, Unterpremstaetten (AT)

(72) Inventors: Horst Gether, Bad Gleichenberg (AT); Martin Schoerkmaier, Graz (AT)

(73) Assignee: ams AG, Unterpremstaetten (AT)

( * ) Notice: Subject to any disclaimer, the term of this patent is extended or adjusted under 35 U.S.C. 154(b) by 0 days.

(21) Appl. No.: 16/072,495

(22) PCT Filed: Jan. 25, 2017

(86) PCT No.: PCT/EP2017/051522
§ 371 (c)(1),
(2) Date: Jul. 24, 2018

(87) PCT Pub. No.: WO2017/129608
PCT Pub. Date: Aug. 3, 2017

(65) Prior Publication Data

US 2019/0088268 A1 Mar. 21, 2019

(30) Foreign Application Priority Data

Jan. 27, 2016 (EP) ..... 16152988

(51) Int. Cl.
*G10L 21/0216* (2013.01)
*H04R 3/00* (2006.01)
(Continued)

(52) U.S. Cl.
CPC ..... *G10L 21/0216* (2013.01); *H04R 1/1083* (2013.01); *H04R 3/005* (2013.01);
(Continued)

(58) Field of Classification Search
None
See application file for complete search history.

(56) References Cited

U.S. PATENT DOCUMENTS

2010/0284525 A1 11/2010 Sander et al.
2011/0116646 A1* 5/2011 Sander ..... H04R 1/1083 381/71.6
(Continued)

FOREIGN PATENT DOCUMENTS

EP 2395500 A1 12/2011
EP 2961196 A1 12/2015
(Continued)

*Primary Examiner* — Paul W Huber
(74) *Attorney, Agent, or Firm* — Fish & Richardson P.C.

(57) ABSTRACT

A method for transmission path noise control using an audio headset and a sending device comprises generating microphone signals by a first and a second microphone of the headset based on detected sound including desired audio information and noise. An encoded signal is generated on a first line of a data cable by means of the headset by encoding input signals depending on the microphone signals. The method comprises transmitting the encoded signal from the headset to the sending device via the first, reconstructing the input signals by decoding the encoded signal by the sending device, generating by the sending device a clean signal by applying a first noise control algorithm to the reconstructed first and second input signal and sending a signal depending on the clean signal to a communication network.

17 Claims, 6 Drawing Sheets

(51) Int. Cl.

| | |
|---|---|
| ***H04R 1/10*** | (2006.01) |
| ***H04R 5/027*** | (2006.01) |
| ***H04R 5/033*** | (2006.01) |
| ***H04R 5/04*** | (2006.01) |

(52) U.S. Cl.
CPC ..... *H04R 5/027* (2013.01); *H04R 5/033* (2013.01); *H04R 5/04* (2013.01); *G10L 2021/02166* (2013.01); *H04R 2201/107* (2013.01); *H04R 2410/05* (2013.01)

(56) References Cited

U.S. PATENT DOCUMENTS

| | | | | |
|---|---|---|---|---|
| 2011/0116750 | A1 | 5/2011 | Terlizzi et al. | |
| 2012/0177213 | A1 | 7/2012 | Le Faucheur | |
| 2013/0034237 | A1 | 2/2013 | Olafsson et al. | |
| 2014/0044275 | A1* | 2/2014 | Goldstein | H04R 3/002 381/71.6 |
| 2014/0146976 | A1* | 5/2014 | Rundle | H04R 1/1083 381/71.6 |
| 2014/0205109 | A1 | 7/2014 | Theiler | |
| 2015/0237435 | A1* | 8/2015 | Wong | H04R 1/1025 381/71.6 |
| 2016/0127815 | A1* | 5/2016 | Ookuri | H04R 1/06 381/119 |

FOREIGN PATENT DOCUMENTS

| | | | |
|---|---|---|---|
| EP | 3007462 | A1 | 4/2016 |
| WO | 2014170181 | A1 | 10/2014 |
| WO | 2014/196399 | A1 | 12/2014 |

* cited by examiner

METHOD AND SYSTEM FOR TRANSMISSION PATH NOISE CONTROL

BACKGROUND OF THE INVENTION

Mobile electronic devices such as mobile phones may use at least two microphones located for example in the mobile phone monitor the ambient noise while doing a phone call. The data of these microphones may be used together with algorithms in order to reduce the background noise while doing a phone call in a noisy environment. This technique is for example denoted transmission noise control. Particular algorithms for transmission noise control have for example been developed by phone manufacturers.

A headset may for example be connected to the electronic device by means of a data cable, for example with four lines and a standard four pole audio jack or a USB connector. Two lines of the data cable carry for example left and right audio signals and one line is a ground connection. Consequently, only a single line may be available for exchanging microphone or further data. Therefore, transmission path noise control may not be possible using the headset as a speech input device.

SUMMARY OF THE INVENTION

The present disclosure provides an improved concept for transmission path noise control using an audio communication device and a sending device connected via a data cable.

Transmission or Tx noise control aims at reduction of noise in a signal transmitted from the sending device to a communication network, where ambient noise is recorded by an input device, for example a headset, together with the desired audio information. In contrast, receiving or Rx noise control aims at reduction of noise received by a user, where ambient noise interferes with an audio signal generated by a speaker.

According to the improved concept for transmission path noise control, at least two microphones of an audio communication device such as an audio headset are used for generating at least two respective input signals based on desired audio information and acoustic noise. The two input signals are encoded by the headset and the encoded signal is transmitted to the sending device via a single line of the data cable. The sending device is used to decode the encoded signal, thereby reconstructing the at least two input signals. The sending device applies a transmission path noise control algorithm to the at least two reconstructed input signals for generating a clean signal representing the desired audio information without or with reduced noise. Then, a signal depending on the clean signal is sent from the sending device to a communication network.

According to the improved concept, a method for transmission path noise control using an audio communication device, in particular an audio headset, and a sending device connected to the audio communication device via a data cable is provided. The method comprises generating a first and a second microphone signal by means of a first and a second microphone of the audio communication device, respectively, based on sound detected by the first and the second microphone. The detected sound includes desired audio information and acoustic noise. The method further comprises generating by means of the audio communication device an encoded signal on a first line, for example an exchange line, of the data cable by encoding at least a first input signal which depends on the first microphone signal and a second input signal which depends on the second microphone signal. The method also comprises transmitting the encoded signal from the audio communication device to the sending device via the first line.

The method further comprises reconstructing the first and the second input signal by decoding the encoded signal by means of the sending device. The method also comprises generating by means of the sending device a clean signal representing the desired audio information by applying a first noise control algorithm, in particular a transmission path noise control algorithm, to at least the reconstructed first and second input signal. The method further comprises sending the clean signal or a signal depending on the clean signal from the sending device to a communication network.

The expression "audio communication device" generally refers to devices for audio input and output comprising at least one microphone and at least one loudspeaker. In particular, the audio communication device may be an audio headset or another communication device such as for example a telephone spider for carrying out telephone conference calls.

The expression "audio headset" generally refers to devices for audio input and output comprising at least one microphone and headphones, earphones, earspeakers, earbuds or at least one loudspeaker. According to the improved concept, the audio headset has at least two microphones, in particular the first and the second microphone.

In the following, the expressions "audio headset" or "headset" are used interchangeably with the expression "audio communication device". In particular, whenever the expression "audio headset" or "headset" is used, it may be replaced by the expression "audio communication device".

According to some implementations, the first microphone is arranged closer to a source of the desired audio information than the second microphone. The source of audio information may for example be a user of the headset speaking to the first microphone, another person speaking to the microphone or any other source of sound located with respect to the first microphone such that sound from the source may be detected by the first microphone.

The desired audio information may for example be audio input, in particular speech input from a user of the headset, that is meant to be sent from the sending device to the communication network. Consequently, the first microphone may predominantly detect the desired audio information or a predominant amount of the desired audio information and the second microphone may detect a different or reduced amount of the desired audio information. For example, the first microphone may be denoted a speech capturing or predominantly speech capturing microphone and the second microphone may be denoted a noise capturing or predominantly noise capturing microphone.

It follows that the first microphone signal represents a first sound signal comprising for example predominantly the desired audio information and a first amount of noise and the second microphone signal represents a second sound signal comprising for example a reduced amount of the desired audio information and a second amount of noise.

The encoded signal is for example generated by modulating, using for example a current or voltage modulation scheme, and/or multiplexing at least the first and the second input signal to the first line of the data cable. The decoding of the encoded signal is for example performed by demodulating, using for example a current or voltage demodulation scheme, and/or de-multiplexing the encoded signal.

According to some implementations, the encoded signal is a digital signal. In some implementations, the first and the second microphone may be analog microphones configured to generate the first and the second microphone signal as analog signals. Then, the first and the second input signal may correspond to digital signals depending on the first and the second microphone signal, respectively. In alternative implementations, the first and the second microphone may be digital microphones configured to generate the first and the microphone signal as digital signals. Then the first and the second input signal may be identical to the first and the second microphone signal, respectively, or may correspond to analog signals depending on the first and the second microphone signal, respectively.

According to some implementations, the reconstructed first and second input signal are digital signals and the applying of the first noise control algorithm is performed by means of a digital signal processor of the sending device.

Since for transmission path noise control timing or latency requirements may be less strict as for example for receiving path must control, digital signal processing may be particularly suitable for transmission path noise control.

The clean signal represents for example the desired audio information without or with a reduced amount of the acoustic noise.

According to some implementations, the data cable comprises a four pole audio jack or a USB connector, in particular a USB-C connector, and four lines including the first line. The sending device comprises for example a four pole audio socket for connecting the data cable via the audio jack or USB connector. In the case of a USB connector, the USB connector may for example be used in an analog audio mode.

According to some implementations, the sending device is implemented by or is comprised by a mobile phone, a tablet computer, a laptop computer or a portable audio player.

According to some implementations, the communication network is one of: telecommunications network, a radio communication network, a GSM network, a GSM based network, a Bluetooth network, a WLAN network, a WiFi network, a LAN network, a wire based communication network.

By means of a method according to the improved concept transmission path noise control may be performed using the audio headset as an input device for the desired audio information, where the headset is connected via the data cable to the sending device. Importantly, only a single line, namely the first line, of the data cable is used for transmitting, in the form of the encoded signal, all information necessary for the sending device for applying the first noise control algorithm.

According to some implementations, the method further comprises generating at least one further second microphone signal by means of at least one further second microphone of the headset based on detected sound including the desired audio information and acoustic noise. The encoded signal is generated by encoding at least the first and the second input signal and at least one further input signal which depends on the at least one further microphone signal. The method further comprises reconstructing the first and the second input signal and the at least one further second input signal by decoding the encoded signal by means of the sending device. The clean signal representing the desired audio signal is generated by means of the sending device by applying the first noise control algorithm to at least the reconstructed first and second input signal and the reconstructed at least one further second input signal.

The at least one further second microphone has the analog function and is analogously connected as the second microphone but may be arranged at a different position of the headset. In this way, in particular by using the reconstructed first, second and at least one further second input signal for generating the clean signal, a further improved noise control may be achieved by means of applying the first noise control algorithm.

According to some implementations, a method for transmission path noise control using an audio headset and a sending device connected to the headset via a data cable comprises determining whether the headset and the sending device are both compatible with transmission path noise control based on at least one identification signal transmitted between the headset and the sending device via a first line of the data cable.

The determining may include a startup sequence. In particular if the headset and the sending device are both compatible with transmission path noise control, the startup sequence may include sending a first identification signal from the sending device to the headset via the first line, detecting the first identification signal by the headset, sending a second identification signal from the headset to the sending device in response to the detection of the first identification signal and detecting the second identification signal by the sending device. The first identification signal is for example recognized by the headset indicating to the headset that the sending device is compatible with transmission path noise control. Analogously, the second identification signal is for example recognized by the sending device indicating to the sending device that the headset is compatible with transmission path noise control.

In case the headset is not compatible with transmission path noise control, the second identification signal is not transmitted. Thus, it is not indicated to the sending device that the headset is compatible with transmission path noise control. Analogously, in case the sending device is not compatible with transmission path noise control, the first identification signal is not transmitted. Thus, it is not indicated to the headset that the sending device is compatible with transmission path noise control.

If it is determined that the headset and the sending device are both compatible with transmission path noise control, the steps of generating the first and the second microphone signal, generating the encoded signal, transmitting the encoded signal via the first line, reconstructing the first and the second input signal, generating the clean signal and sending the signal depending on the clean signal may be performed as described above.

On the other hand, if it is determined that the headset or the sending device is not compatible with transmission path noise control, the method comprises generating the first microphone signal by means of the first microphone, transmitting the first microphone signal from the headset to the sending device via the first line of the data cable and sending a signal depending on the first microphone signal to a communication network.

In the described way, full legacy or downwards compatibility of the headset and/or the sending device may be achieved.

According to some implementations of the method, in particular if the headset is compatible with transmission path noise control and the sending device is or is not compatible with transmission path noise control, the method further comprises transmitting an audio signal from the sending device to the headset via a second line, for example an audio line, of the data cable. The method further comprises generating by means of the headset a compensated audio signal by applying a second noise control algorithm at least to the audio signal or a signal depending on the audio signal and the second microphone signal or a signal depending on the second audio signal. The method further comprises generating by means of a speaker of the headset an acoustic speaker signal based on the compensated audio signal.

The second noise control algorithm is in particular a receiving path noise control algorithm, for example an active noise control algorithm, for example an analog active noise control algorithm or a digital active noise control algorithm.

Using the second microphone signal for generating the compensated audio signal corresponds for example to a feed-forward technique for receiving path noise control. Advantageously, the second microphone and the second microphone signal may simultaneously be used for generating the encoded signal for the transmission path noise control and for generating the compensated audio signal by means of the receiving path noise control. In alternative implementations, a separate microphone may analogously be used for the receiving path noise control instead of the second microphone.

According to some implementations, the second noise control algorithm is applied to at least the audio signal and the second microphone signal by means of an active noise control circuit of the headset configured to apply filter operations to at least the audio signal and the second microphone signal. Optionally, at least the audio signal and/or the second microphone signal may be amplified before the filter operations being applied.

According to some implementations, the method further comprises detecting by means of a third microphone of the headset a disturbed speaker signal, in particular an acoustic disturbed speaker signal, depending on the speaker signal and generating by means of the third microphone a third microphone signal based on the disturbed speaker signal. The compensated audio signal is generated by applying the second noise control algorithm at least to the audio signal or the signal depending on the audio signal, the second microphone signal or the signal depending on the second microphone signal and the third microphone signal or a signal depending on the third microphone signal. The disturbed microphone signal may for example correspond to the speaker signal disturbed by ambient noise.

Using the third microphone signal for generating the compensated audio signal corresponds for example to a feed-back technique for receiving path noise control. By means of such implementations, the feed-forward technique based on the second microphone signal and the feed-back technique based on the third microphone signal may be combined to further improve the receiving path noise control.

According to some implementations of the method, in particular if the headset and the sending device are both compatible with transmission path noise control, the encoded signal is generated by encoding at least the first and the second input signal and an error signal which depends on the third microphone signal and the method further comprises reconstructing the error signal by means of the decoding of the encoded signal.

According to some implementations, the method further comprises adapting by means of the sending device the audio signal depending on the reconstructed error signal.

In this way, for example an adaptive equalizing function may be realized based on the error signal for example simultaneously to the noise control.

According to some implementations, the third microphone is an analog microphones configured to generate the third microphone signal as an analog signal. Then, the error signal may correspond to a digital signal depending on the third microphone signal. In alternative implementations, the third microphone is a digital microphones configured to generate the third microphone signal as a digital signal. Then the error input signal may be identical to the third microphone signal or correspond to an analog signal depending on the third microphone signal.

According to some implementations, the method further comprises generating by means of the sending device an adaption signal depending on the error signal. The method further comprises transmitting a signal depending on the adaption signal from the sending device to the headset via the first line and adapting by means of the headset the second noise control algorithm based on the signal depending on the adaption signal.

In this way, based on the error signal a performance of the second noise control algorithm may be checked and for example adaptively optimized for example by changing filter parameters applied to the audio signal, the second microphone signal and/or the third microphone signal or the respective signals depending thereupon in the course of the second noise control algorithm.

According to some implementations, in particular if the headset and the sending device are both compatible with transmission path noise control, the method further comprises generating a control signal by means of at least one control element of the headset. The encoded signal is generated by encoding at least the first and the second microphone signal and the control signal. The method further comprises reconstructing the control signal by means of the encoded signal. The sending device may for example adapt or change a setting or function of the sending device and/or the headset depending on the reconstructed control signal.

The at least one control element of data may for example be one or more buttons for example for controlling a function or setting of the headset and/or the sending device such as for example a volume setting, a microphone mute setting and so forth or an application being executed by the sending device.

According to some implementations the method further comprises transmitting a data signal, in particular a data signal being encoded by the sending device, from the sending device to the headset via the first line and processing the data signal or a reconstructed data signal by means of an electronic device comprised by the headset. The reconstructed data signal is for example generated by decoding by means of the headset the data signal being encoded by the sending device.

According to some implementations the method further comprises transmitting a data signal, in particular a data signal being encoded by the sending device, from the sending device to the headset via the first line and displaying information on a display of the headset depending on the data signal, in particular depending on a reconstructed data signal. The reconstructed data signal is for example generated by decoding by means of the headset the data signal being encoded by the sending device.

According to some implementations the method further comprises generating a further data signal based on further information being stored in a storage device of the headset and transmitting the further data signal or a further encoded signal depending on the further data signal from the headset to the sending device via the first line.

The further information may for example include user specific data and/or device specific data of the headset, for example a serial number of the headset.

According to some implementations, the method further comprises transmitting electrical power from the sending device to the headset via the first line and biasing the first and/or the second microphone based on the transmitted electrical power.

According to some implementations the display and/or the active noise control circuit may be powered based on the transmitted electrical power.

According to some implementations the method further comprises generating a sensor signal by means of a sensor of the headset. The encoded signal is generated by encoding at least the first and the second input signal and a signal which depends on the sensor signal and the method further comprises reconstructing the sensor signal by means of the decoding of the encoded signal.

The sensor may for example be a sensor configured to determine an environmental parameter. The sensor may for example be a temperature sensor, a heartrate sensor a pressure sensor or another sensor.

According to some implementations, in particular if the headset and the sending device are both compatible with transmission path noise control, the method further comprises intermediately storing the clean signal or the signal depending on the clean signal before sending the cleans signal or the signal depending on the clean signal to the communication network.

In alternative implementations, the clean signal or the signal depending on the clean signal is sent immediately after generating the clean signal. Therein, the expression "immediately" may include delays as far as data processing, for example generating the signal depending on the clean signal, is concerned.

According to the improved concept, also a system for transmission path noise control comprising an audio headset and a sending device connected or connectable to the headset via a data cable, in particular a data cable of the headset is provided. The headset comprises a first and a second microphone configured to generate a first and a second microphone signal, respectively, based on sound detected by the first and the second microphone, wherein the sound includes desired audio information and acoustic noise. The headset further comprises an encoder, for example a first encoder-decoder, configured to generate an encoded signal on a first line of the data cable by encoding at least a first input signal which depends on the first microphone signal and a second input signal which depends on the second microphone signal.

The sending device comprises a decoder, for example a second encoder-decoder, configured to reconstruct the first and the second input signal by decoding the encoded signal, a signal processing unit, in particular a digital signal processing unit, configured to generate a clean signal representing the desired audio information by applying a first noise control algorithm to at least the reconstructed first and second input signal. The sending device further comprises a network unit configured to send the clean signal or a signal depending on the clean signal to a communication network.

Further implementations of the system for transmission path noise control are readily derived from the various implementations of the method for transmission path noise control and vice versa.

According to the improved concept, also a headset for transmission path noise control connectable a sending device via a data cable is provided. The headset comprises a first and a second microphone configured to generate a first and a second microphone signal, respectively, based on sound detected by the first and the second microphone, wherein the sound includes desired audio information and acoustic noise. The headset further comprises an encoder configured to generate an encoded signal on a first line of the data cable by encoding at least a first input signal which depends on the first microphone signal and a second input signal which depends on the second microphone signal.

According to the improved concept, also a sending device for transmission path noise control connectable to a headset via a data cable is provided. The sending device comprises a decoder configured to reconstruct a first and a second input signal by decoding an encoded signal received from the headset via a first line of the data cable, a signal processing unit, in particular a digital signal processing unit, configured to generate a clean signal representing desired audio information by applying a first noise control algorithm to at least the reconstructed first and second input signal. The sending device further comprises a network unit configured to send the clean signal or a signal depending on the clean signal to a communication network.

Further implementations of the headset and the sending device are readily derived from the various implementations of the method and the system for transmission path noise control and vice versa.

BRIEF DESCRIPTION OF THE DRAWINGS

In the following, the improved concept is explained in detail with the aid of exemplary implementations by reference to the drawings. Components that are functionally identical or have an identical effect may be denoted by identical references. Identical components and/or components with identical effects may be described only with respect to the figure where they occur first. Their description is not necessarily repeated in subsequent figures.

In the drawings.

DETAILED DESCRIPTION

Figure 1:
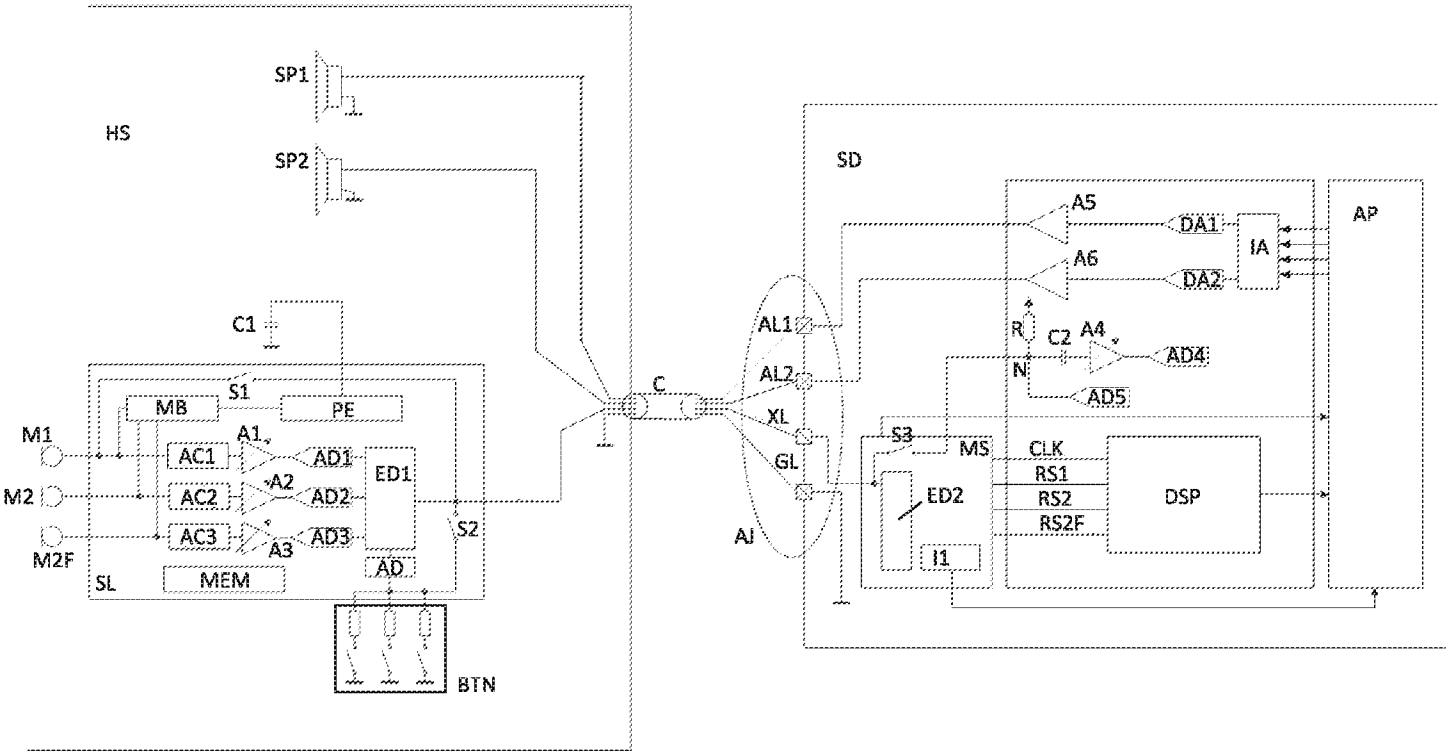
FIG. 1 shows an exemplary implementation of a system for transmission path noise control according to the improved concept.

FIG. 1 shows an exemplary implementation of a system for transmission path noise control according to the improved concept. The system comprises an audio headset HS, for example implemented as earbuds or headphones, and a sending device SD, for example a mobile phone or a tablet computer. The headset HS and the sending device SD are connected via a data cable C. The data cable C is for example a four pole data cable for example with a four pole audio jack AJ for connecting to a four pole audio socket of the sending device SD. As an alternative to the four pole audio jack AJ a USB connector, in particular a USB-C connector, as well as a corresponding USB socket of the sending device SD may be used.

The headset HS comprises for example a first speaker SP1 and a second speaker SP2 connected to a first audio line AL1 and a second audio line AL2 of the data cable C, respectively. The sending device SD comprises an application processor AP connected for example to an audio interface IA, for example an $I^2S$ interface, of the sending device SD. The audio interface IA may be coupled to the first audio line AL1 via a first digital-to-analog converter, DAC, DA1 and a first audio amplifier A5 coupled in series. The audio interface IA may be coupled to the second audio line AL2 via a second DAC DA2 and a second audio amplifier A6 coupled in series.

The application processor AP is for example configured to send audio data, in particular digital audio data, to the audio interface IA, for example via a bus. The audio interface IA may for example generate a first and a second digital audio signal based on the audio data and send them to the first and the second DAC DA1, DA2, respectively. Analog output signals of the first and the second DAC DA1, DA2 are for example amplified by the first and the second audio amplifier A5, A6, respectively, for generating a first audio signal on the first audio line AL1 and a second audio signal on the second audio line AL2, respectively. The first and the second speaker SP1, SP2 may then generate acoustic first and second speaker signals, respectively, based on the first and the second audio signal.

In the headset HS comprises a first microphone M1 and a second microphone M2 and for example an optional further second microphone M2F. The headset HS further comprises a slave circuit SL, in particular a slave integrated circuit, with a first encoder-decoder ED1. The first encoder-decoder ED1 is connected to an exchange line XL of the data cable C. The exchange line XL may for example correspond to a microphone line of the data cable C. In some implementations, the first and the second microphones M1, M2, M2F may be analog microphones. In such implementations, the first microphone M1 is coupled to the first encoder-decoder ED1 via a first series connection comprising a first AC coupling AC1, a first amplifier A1, for example a tunable amplifier, and a first analog-to-digital converter, ADC, AD1. Analogously, the second microphones M2, M2F are coupled to the first encoder-decoder ED1 by respective second and third series connections comprising a second and a third AC coupling AC2, AC3, a second and a third amplifier A2, A3, for example tunable amplifiers, and a second and a third ADC AD2, AD3, respectively. Therein, the AC couplings AC1, AC2, AC3 may for example be configured to reject a DC component of the respective microphone output and forward only respective AC components to the amplifiers A1, A2, A3 and the ADCs AD1, AD2, AD3. The AC couplings AC1, AC2, AC3 may for example be implemented as RC-elements. In alternative implementations, the first and the second microphones M1, M2, M2F may be digital microphones. In such implementations, the microphones M1, M2, M2F are for example directly connected to the first encoder-decoder ED1 and the slave circuit SL may not comprise the AC couplings AC1, AC2, AC2, the amplifiers A1, A2, A3 and the ADCs AD1, AD2, AD3.

The sending device SD comprises a master circuit MS, in particular a master integrated circuit, comprising a second encoder-decoder ED2 connected to the exchange line XL. The sending device SD further comprises a digital signal processor DSP connected to the application processor AP and connected, for example via a further bus, to the master circuit MS.

The first microphone M1 is arranged to detect a desired audio information, for example speech of a user of the headset or other to be recorded or detected sound input. For example, the first microphone M1 is a speech microphone. In addition to the desired audio information, the first microphone M1 may detect acoustic noise, for example ambient noise. The second microphones M2, M2F may be noise microphones that may be arranged spaced apart from the first microphone M1 and for example from each other. Consequently, the second microphones M2, M2F may detect sound including the acoustic noise and for example a part or a reduced amount of the desired audio information.

Based on the detected desired audio information and acoustic noise, the first microphone M1 generates a first microphone signal. Based on the first microphone signal, the first AC coupling AC1, the first amplifier A1 and the first ADC AD1 generate a first input signal and provide it to the first encoder-decoder ED1. Analogously, the second microphones M2, M2F generate a second microphone signal and a further second microphone signal, respectively, based on the detected desired audio information and acoustic noise. Based on the second microphone signals, the second and the third AC coupling AC2, AC3, the second and the third amplifier A2, A3 and the second and the third ADC AD2, AD3, generate a second input signal and a further second input signal, respectively, and provide them to the first encoder-decoder ED1. In implementations with the digital microphones M1, M2, M2F, the first, second and further second microphone signals are for example directly supplied to the first encoder-decoder ED1 as first, second and further second input signals.

The first encoder-decoder ED1 generates an encoded signal by encoding for example the first, the second and the further second input signal for example by modulating them to the exchange line XL. The encoded signal is transmitted via the exchange line XL to the second encoder-decoder ED2, which may reconstruct the first, the second and the further second input signal by decoding, in particular demodulating, the encoded signal. The reconstructed first, second and further second input signal RS1, RS2, RS2F are supplied to the digital signal processor DSP. Therein, an output format of the master circuit may for example be $I^2S$, pulse code modulation, PCM, or impulse density modulation, PDM. Furthermore, the master circuit MS may for example provide a clock signal CLK to the digital signal processor DSP.

Alternatively, the clock signal CLK may be generated by the digital signal processor DSP or the application processor AP and provided for example to the master circuit MS. In this way it may for example be ensured that the clock signal CLK is synchronous to the rest of the audio system.

The digital signal processor DSP applies a first noise control algorithm, in particular a transmission path noise control algorithm, for example to the reconstructed first, second and further second input signal RS1, RS2, RS2F. As a result of the first noise control algorithm, the digital signal processor DSP may generate a clean signal at its output and provide it to the application processor AP. The clean signal represents the desired audio information in particular without the acoustic noise or with reduced noise. The application processor AP may for example send the clean signal or a signal depending on the clean signal to a communication network, for example a telecommunications network, for example via a network unit (not shown), for example a radio unit, of the sending device SD.

In the described way, transmission path noise control may be performed by means of a system according to the improved concept. The system uses the headset HS as an input device for the desired audio information and transmits all data required for the transmission path noise control algorithm applied by the digital signal processors SD via a single line of the data cable C, namely to exchange line XL. The communication via the exchange line XL allows bidirectional full duplex communication. It is highlighted that the generation of the first and the second speaker signal is independent from the slave circuit SL and the transmission of the encoded signal to the sending device SD.

Optionally, the headset HS may comprise a control element BTN, comprising for example one or more buttons, for example three or more buttons. The control element BTN is for example implemented by means of one or more switches coupled in parallel. Each of the switches is for example coupled in series with a respective resistor. The resistors have for example different resistances. An output of the control element BTN is for example coupled to the first encoder-decoder ED1 via a further ADC AD. The master circuit MS may comprise a first data interface I1 connected to the second encoder-decoder ED2 (connection not shown) and to the application processor AP. The first data interface I1 may for example be an PC interface or a serial peripheral interface, SPI.

If one of the switches of the control element BTN is closed, corresponding for example to a user pressing a respective button, a signal is generated at the output of the control element BTN the signal depending on which of the switches has been closed for example due to the different resistance values of the resistors. The further ADC AD may then generate a control signal based on the output of the control element BTN and provide it to the first encoder-decoder ED1. Consequently, the encoded signal may for example be generated by encoding, in particular modulating, the first and second input signals at described above as well as the control signal on the exchange line XL.

The second encoder-decoder ED2 may reconstruct the control signal by decoding, in particular demodulating, the encoded signal. The second encoder-decoder ED2 may then transmit the reconstructed control signal for example via the first data interface I1 to the application processor AP. The application processor AP may for example change a setting, for example a setting of the sending device SD or the headset HS, for example a volume setting or a microphone setting or adapt the audio data sent to the audio interface IA depending on the reconstructed control signal. Alternatively or in addition, the application processor AP may control an application executed on the sending device SD depending on the reconstructed control signal.

Optionally, the headset may for example comprise a storage device MEM connected to the first encoder-decoder ED1. The storage device MEM may comprise stored information such as for example user specific data and/or device specific data of the headset. Depending on the stored information, the storage device MEM may provide a data signal to the first encoder-decoder ED1. The encoded signal may for example be generated by encoding, in particular modulating, the first and second input signals at described above as well as the data signal from the storage device MEM on the exchange line XL. Alternatively, the first encoder-decoder ED1 may generate a further encoded signal at the exchange line XL by encoding the data signal. The further encoded signal may for example be generated during a preamble phase of operation before the encoded signal is generated based on the first, second and further second input signal.

The second encoder-decoder ED2 may reconstruct the data signal by decoding, in particular demodulating, the encoded or further encoded signal. The second encoder-decoder ED2 may then transmit the reconstructed data signal for example via the first data interface I1 to the application processor AP.

Optionally, the headset HS further comprises a power extraction unit PE connected to the exchange line XL (connection not shown) and a bias unit MB connected to the power extraction unit PE. The power extraction unit PE may be connected to a ground terminal of the headset HS for example via a capacitor C1. The bias unit MB is for example further connected to the first and second microphones M1, M2, M2F.

The sending device SD, in particular the master circuit MS, may be configured to transmit electrical power via the exchange line HL to the headset HS. The power extraction unit PE is configured to extract the transmitted electrical power and to supply a voltage and/or current to the bias unit MB. Based on the supplied voltage and/or current, the bias unit MB may for example supply respective bias voltages to the first, second and further second microphone M1, M2, M2F.

Optionally, the first microphone M1 is connected to the exchange line XL via a first bypass switch S1 of the slave circuit SL and, if applicable, the control element BTN is connected to the exchange line XL via a second bypass switch S2 of the slave circuit SL. The slave circuit SL is for example configured to close the first and/or the second bypass switch S1, S2 in case an alternative sending device (not shown) is connected to the headset HS via the data cable C instead of the sending device SD as shown in FIG. 1. The alternative sending device is not compatible with transmission path noise control as described above. In particular, the alternative sending device may not comprise the master circuit MS and the digital signal processor DSP as described above. In this case, the first microphone signal may be directly sent to the alternative sending device via the exchange line XL.

Optionally, if the first and the second bypass switches S1, S2 are closed, the output of the control element BTN may be used to modulate the first microphone signal to transmit information about which of the switches of the control element BTN is closed to the alternative sending device. In this way, the headset HS shown in FIG. 1 may provide basic functionality, that is functionality of the first microphone M1 and the control element BTN, in case the alternative sending element being not compatible with transmission path noise control is connected. For further details on determining whether the sending device is compatible with transmission path noise control, it is referred to the explanations with respect to FIG. 7.

The sending device SD may for example comprise a fourth ADC AD4 with an output connected for example to the application processor AP (connection not shown). The sending device SD may further comprise a fourth amplifier A4, in particular a tunable amplifier, with an output connected to an input of the fourth ADC AD4. A capacitor C2 is for example connected between an input of the fourth amplifier A4 and a circuit node N. A resistor R may be connected between the circuit node N and a supply voltage of the sending device SD. Furthermore, the sending device SD may comprise a fifth ADC AD5 with an output connected for example to the application processor AP (connection not shown) and with an input connected to the circuit node N. The circuit node N is for example connected via a third bypass switch S3 of the master circuit MS to the exchange line XL.

The master circuit MS is for example configured to close the third bypass switch S3 in case an alternative headset (not shown) is connected to the sending device SD via the data cable C instead of the headset HS as shown in FIG. 1. The alternative headset is not compatible with transmission path noise control as described above. In particular, the alternative headset may not comprise the slave circuit SL as described above. In this case, the sending device SD may for example receive an analog microphone signal that may optionally be modulated with control data for example of buttons of the alternative headset via the exchange line XL. The arrangement of the resistor R and the capacitor C2 serves as an AC coupling for the fourth amplifier A4. Thus, the fourth amplifier A4 may receive and amplify an AC part of the analog microphone signal. The fourth ADC AD4 may then generate for example speech data based on the AC part of the microphone signal. The fifth ADC AD5 which may be not AC coupled may for example measure a DC part of the analog microphone signal. Consequently, an output of the fifth ADC AD5 may for example correspond to the control data modulating the analog microphone signal.

In this way, the sending device SD as shown in FIG. 1 may provide basic functionality in case the alternative headset being not compatible with transmission path noise control is connected. For further details on determining whether the headset is compatible with transmission path noise control, it is referred to the explanations with respect to FIG. 7.

The data cable C comprises for example a ground line GL connecting for example the ground terminal of the headset HS and a ground terminal of the sending device SD.

Optionally, the master circuit MS may transmit the clock signal CLK to the slave circuit SL via the exchange line XL. The slave circuit SL may extract the transmitted clock signal CLK for example for data transmission from the headset HS to the sending device SD.

The sending device SD may comprise an audio codec circuit. The audio codec circuit may for example comprise the audio interface IA, the first and second DAC DA1, DA2 and the first and second audio amplifier A5, A6. The audio codec circuit may for example also comprise the digital signal processor DSP. In alternative implementations, the digital signal processor DSP is not comprised by the audio codec circuit. The audio codec circuit may further comprise the fourth and fifth ADC AD4, AD5, the fourth amplifier A4, the resistor R and the capacitor C2.

Figure 2:
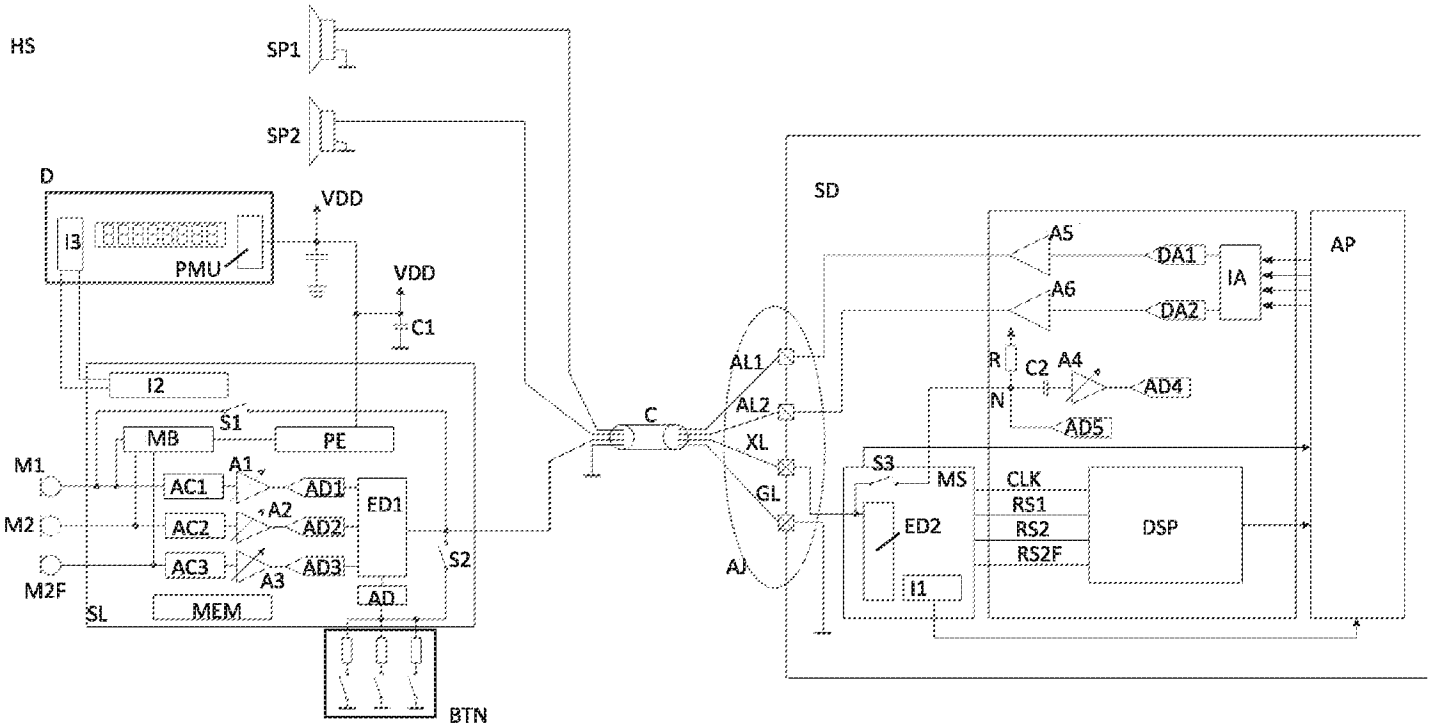
FIG. 2 shows a further exemplary implementation of a system for transmission path noise control according to the improved concept.

FIG. 2 shows a further exemplary implementation of a system for transmission path noise control according to the improved concept based on the system of FIG. 1.

The slave circuit SL of the headset HS of FIG. 2 further comprises a second data interface 12, for example an PC interface or an SPI, connected to the first encoder-decoder ED1 (connection not shown). The headset HS of FIG. 2 further comprises a display D with a third data interface 13, for example an PC interface or an SPI, connected to the second data interface 12. The display further comprises a power management unit PMU connected to the power extraction unit PE.

The full-duplex capability of the master/slave solution allows for example for an PC tunneling function.

The application processor AP may for example send display data via the first data interface I1 to the second encoder-decoder ED2. The second encoder-decoder ED2 may encode the display data and send the encoded display data to the first encoder-decoder ED1 via the exchange line XL. The first encoder-decoder ED1 may reconstruct the display data by decoding the encoded display data and provide the reconstructed display data to display via the second and the third data interface 12, 13. The display D may display information on a screen of the display D depending on the received reconstructed display data. In analogy to the display data, also the clock signal CLK may be transmitted from the master circuit MS to the display D for a timing of the data exchange.

The display D is for example powered via the power management unit PMU and the power extraction unit PE based on the electrical power considered from the sending device SD to the headset HS.

Figure 3:
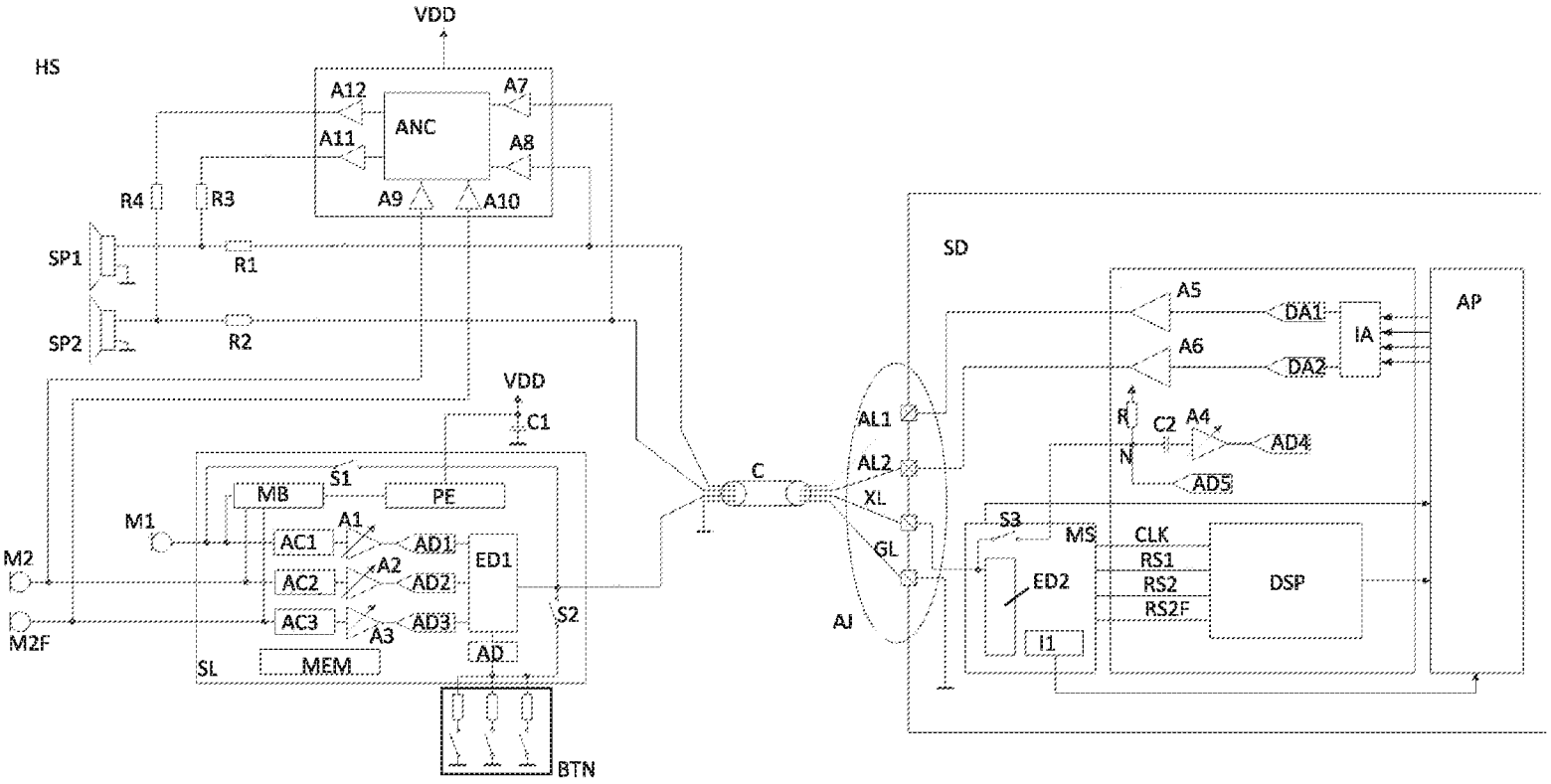
FIG. 3 shows a further exemplary implementation of a system for transmission path noise control according to the improved concept.

FIG. 3 shows a further exemplary implementation of a system for transmission path noise control according to the improved concept based on the system of FIG. 1.

The headset HS of FIG. 3 further comprises an active noise control circuit ANC. The first and the second audio lines ALL AL2 are coupled to a first and a second input of the active noise control circuit ANC for example via amplifiers A7, A8, respectively. The second and the further second microphone M2, M2F are coupled to a third and a fourth input of the active noise control circuit ANC for example via amplifiers A9, A10, respectively. The first and second speaker SP1, SP2 are connected to a first and a second output of the active noise control circuit ANC for example via amplifiers A11, A12, respectively. The headset HS comprises a first resistor R1 connected between the first audio line AL1 and the first speaker SP1 and a second resistor R2 coupled between the second audio line AL2 and the second speaker SP2. The headset HS further comprises a third resistor R3 connected between the amplifier A11 and the first speaker SP1 and a fourth resistor R4 connected between the amplifier A12 and the second speaker SP2.

By means of an implementation according to FIG. 3, receiving path noise control may be combined with the transmission path noise control described with respect to FIG. 1.

For the receiving path noise control, the first and the second audio signal generated by means of the application processor AP, the audio interface IA, the DACs DA1, DA2 and the audio amplifiers A5, A6 as described with respect to FIG. 1, are transmitted from the sending device SD to the headset HS via the first and second audio line ALL AL2 and received at the first and the second input, respectively, of the active noise control circuit ANC for example via the amplifiers A7, A8. The second microphone signal and the further second microphone signal are received at the third and the fourth input, respectively, of the active noise control circuit ANC for example via the amplifiers A9, A10.

The active noise control circuit ANC is configured to apply a second noise control algorithm, in particular an active noise control algorithm, to the first and the second audio signal and to the second and further second microphone signal or to the outputs of the amplifiers A7, A8, A9, A10. The second noise control algorithm is applied for example by applying filter operations to said signals. As a result of the second active noise control algorithm, a first and a second compensation signal, in particular active noise control compensation signal, are generated at the first and the second output of the active noise control circuit ANC or the outputs of the amplifiers A11, A12, respectively.

The receiving path noise control by means of the active noise control circuit ANC of FIG. 3 is for example based on a passive summing technology. The first and the second audio signal are mixed together with the first and the second compensation signal via the resistors R1, R2, R3, R4 to generate a first and a second compensated audio signal, respectively. The first and the second compensated audio signals are provided to the first and the second speaker SP1, SP2, respectively, which generate the first and the second speaker signal based on the compensated audio signals.

An advantage of the solution of FIG. 3 is a lower power consumption in the headset HS because the sending device SD is driving the speakers SP1, SP2 for generating the speaker signals.

By means of an implementation according to FIG. 3, transmission path noise control and receiving path noise control may both be realized utilizing the same noise microphones, namely the second and further second microphone M2, M2F. Alternatively, separate microphones may be used for the receiving path noise control.

Figure 4:
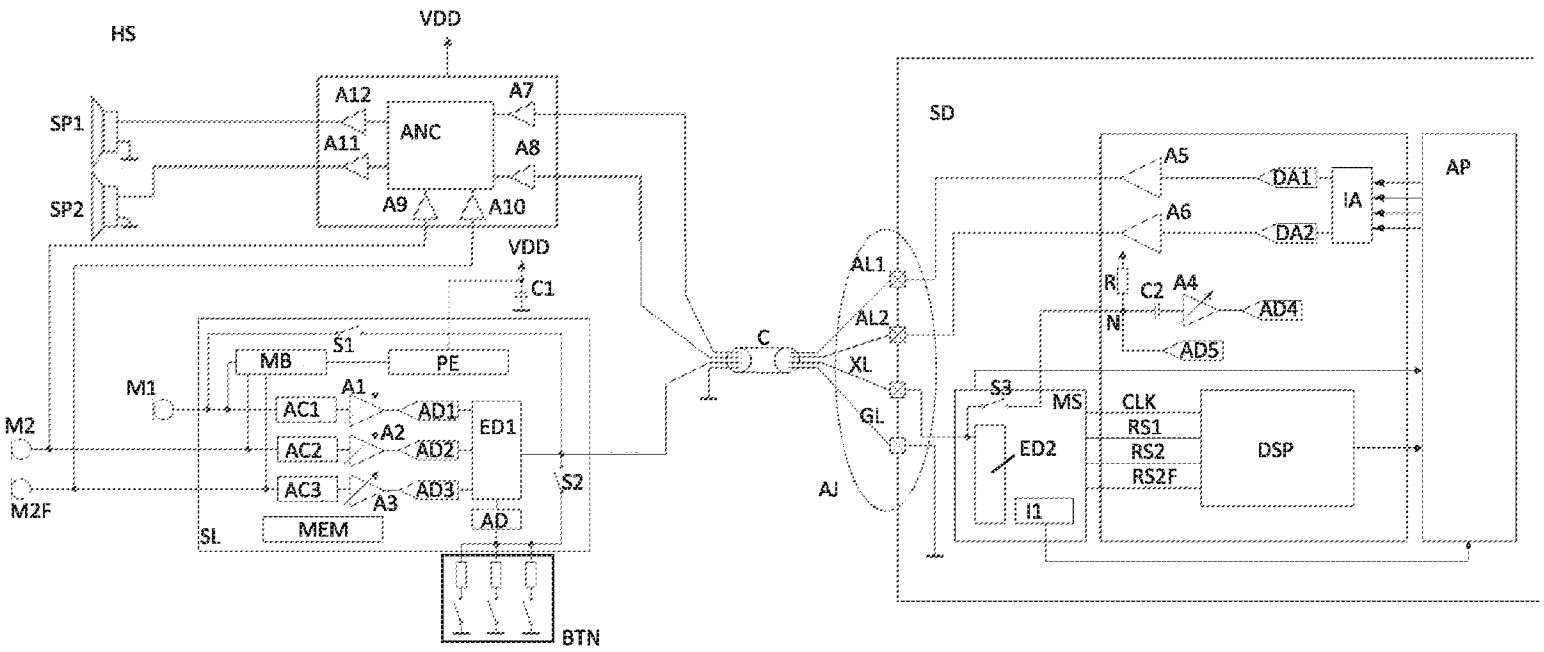
FIG. 4 shows a further exemplary implementation of a system for transmission path noise control according to the improved concept.

FIG. 4 shows a further exemplary implementation of a system for transmission path noise control according to the improved concept based on the system of FIG. 1.

The headset HS of FIG. 4 further comprises an active noise control circuit ANC. The first and the second audio line ALL AL2 are coupled to a first and a second input of the active noise control circuit ANC for example via amplifiers A7, A8, respectively. The second and the further second microphone M2, M2F are coupled to a third and a fourth input of the active noise control circuit ANC for example via amplifiers A9, A10, respectively. The first and the second speaker SP1, SP2 are connected to a first and a second output of the active noise control circuit ANC for example via amplifiers A11, A12, respectively.

By means of an implementation according to FIG. 4, receiving path noise control may be combined with the transmission path noise control described with respect to FIG. 1.

For the receiving path noise control, the first and the second audio signal generated by means of the application processor AP, the audio interface IA, the DACs DA1, DA2 and the audio amplifiers A5, A6 as described with respect to FIG. 1, are transmitted from the sending device SD to the headset HS via the first and second audio line AL1, AL2 and received at the first and the second input, respectively, of the active noise control circuit ANC for example via the amplifiers A7, A8. The second microphone signal and the further second microphone signal are received at the third and the fourth input, respectively, of the active noise control circuit ANC for example via the amplifiers A9, A10.

The active noise control circuit ANC is configured to apply a second noise control algorithm, in particular an active noise control algorithm, to the first and the second audio signal and to the second and further second microphone signal or to the outputs of the amplifiers A7, A8, A9, A10. The second noise control algorithm is applied for example by applying filter operations to said signals. As a result of the second active noise control algorithm, a first and a second compensated audio signal are generated at the first and the second output of the active noise control circuit ANC or the outputs of the amplifiers A11, A12, respectively. The first and the second compensated audio signals are provided to the first and the second speaker SP1, SP2, respectively, which generate the first and the second speaker signal based on the compensated audio signals.

For example, in contrast to the implementation of FIG. 3, the first and the second speaker SP1, SP2 are not additionally connected to the first and the second audio line AL1, AL2. The receiving path noise control of FIG. 4 is thus not based on passive summing as in FIG. 3. Rather, the active noise control circuit ANC directly generates the compensated audio signals to the speakers SP1, SP2. Thus, the first and the second speaker SP1, SP2 are driven by the active noise control circuit ANC.

By means of an implementation according to FIG. 4, transmission path noise control and receiving path noise control may both be realized utilizing the same noise microphones, namely the second and further second microphone M2, M2F. Alternatively, separate microphones may be used for the receiving path noise control.

Figure 5:
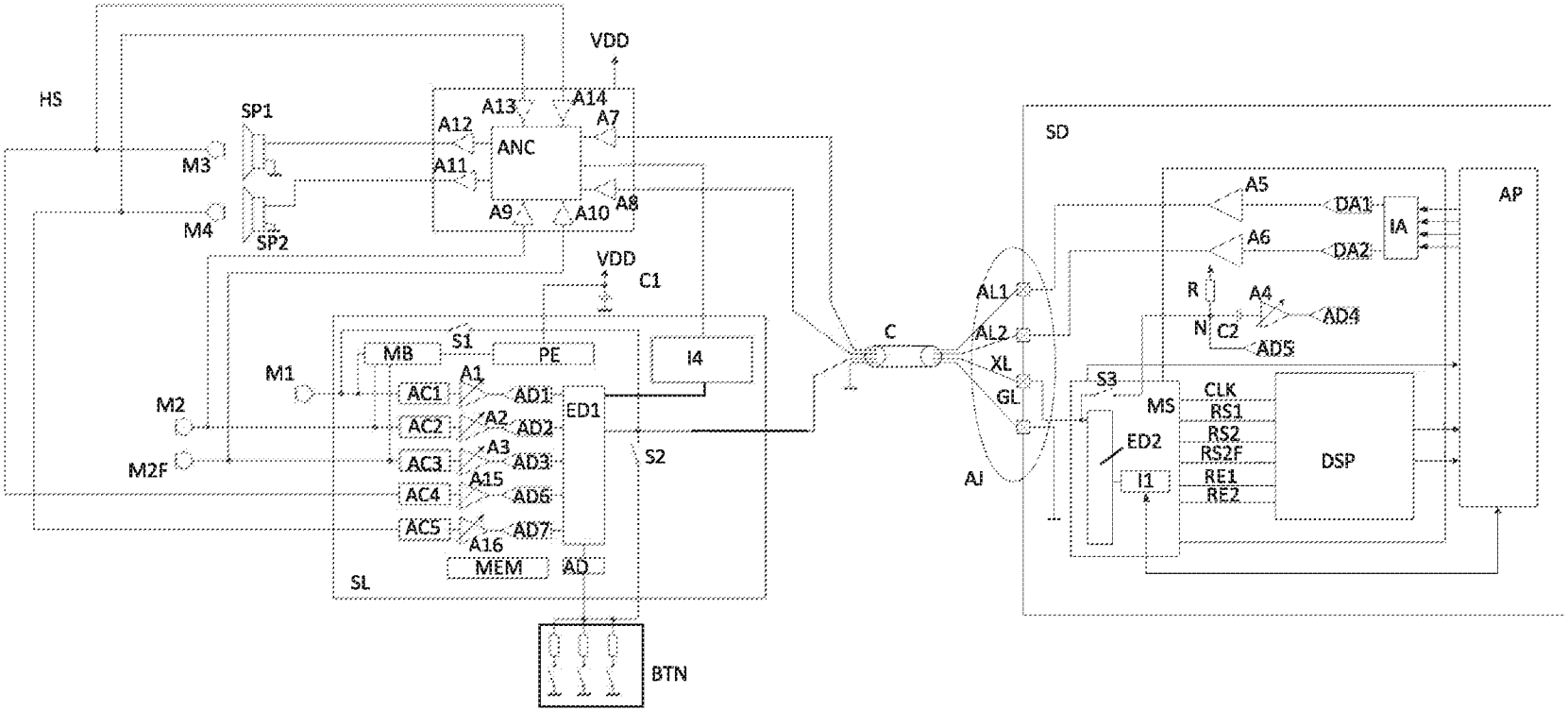
FIG. 5 shows a further exemplary implementation of a system for transmission path noise control according to the improved concept.

FIG. 5 shows a further exemplary implementation of a system for transmission path noise control according to the improved concept based on the system of FIG. 4.

In addition, the headset HS comprises a first and a second error microphone M3, M4 arranged in for example in close vicinity to the first and the second speaker SP1, SP2, respectively, for example at sides of acoustic output of the speakers SP1, SP2. The first error microphone M1 is for example coupled to the first encoder-decoder ED1 via a fourth series connection comprising a fourth AC coupling AC4, an amplifier A15, for example a tunable amplifier, and a sixth ADC AD6. Analogously, the second error microphone M3 is for example coupled to the first encoder-decoder ED1 by a fifth series connection comprising a fifth AC coupling AC5, an amplifier A16, for example a tunable amplifier, and seventh ADC AD7. The AC couplings AC4, AC5 may for example be configured to reject DC components of the respective microphone outputs and forward only respective AC components to the amplifiers A15, A16 and the ADCs AD6, AD7.

Furthermore, the first error microphone M3 is coupled to a fourth input of the active noise control circuit ANC, for example via an amplifier A13 and the second error microphone M4 is coupled to a fifth input of the active noise control circuit ANC, for example via an amplifier A14. The slave circuit SL further comprises a fourth data interface 14, for example an $I^2C$ interface or an SPI, connected between the first encoder-decoder ED1 and a control input of the active noise control circuit ANC.

The first and the second error microphone M3, M4 detect a disturbed first and second speaker signal, respectively. The first and the second disturbed speaker signal correspond to the first and the second speaker signal generated by the first and the second speaker SP1, SP2, respectively, disturbed by acoustic noise, in particular ambient noise. The first and the second error microphone M3, M4 generate a third and a fourth microphone signal, respectively, based on the detected disturbed speaker signals. The compensated audio signal is generated by the active noise control circuit ANC by applying the second noise control algorithm to the first and the second audio signal, the second and further second microphone signal and the third and the fourth microphone signal.

Consequently, while the receiving noise control according to FIGS. 3 and 4 is based on feed-forward techniques, the receiving noise control according to FIG. 5 additionally has a feed-back arrangement with the first and the second error microphone M3, M4 and the respective connections to the active noise control circuit ANC. In this way, the receiving noise control may be further improved.

Furthermore, based on the third microphone signal, the fourth AC coupling AC4, the amplifier A15 and the sixth ADC AD6 may generate a first error signal and provide it to the first encoder-decoder ED1. Based on the fourth microphone signal, the fifth AC coupling AC5, the amplifier A16 and the seventh ADC AD7 may generate a second error signal and provide it to the first encoder-decoder ED1.

The first encoder-decoder ED1 may generate the encoded signal by encoding for example the first, the second and the further second input signal and the first and the second error signal for example by modulating them to the exchange line XL. The second encoder-decoder ED2 may reconstruct the first and the second error signal by decoding, in particular demodulating, the encoded signal. The reconstructed first and the second error signal RE1, RE2 may be supplied to the digital signal processor DSP. The digital signal processor DSP may generate error information based on the first and the second error signal and provide it to the application processor AP.

In some implementations, the application processor AP may for example adapt the first and the second audio signal, in particular by adapting the audio data being sent to the audio interface IA, depending on the error information. In this way, an adaptive equalization of the first and the second audio signal may be performed by means of the sending device SD.

In some implementations, the sending device SD may generate an adaption signal based on the error information and send the adaption signal to the headset HD via the exchange line XL. To this end, a signal generated by the application processor AP depending on the error information is for example sent to the second encoder-decoder ED2 the first data interface I1 and encoded by the second encoder-decoder ED2. The encoded adaption signal is transmitted via the exchange line XL to the first encoder-decoder ED1, which may reconstruct the adaption signal by decoding the encoded adaption signal received from the second encoder-decoder ED2. The reconstructed adaption signal is then provided for example to the active noise control circuit ANC. The active noise control circuit ANC may for example adapt the second noise control algorithm, in particular filter parameters of the active noise control circuit ANC, based on the reconstructed adaption signal. In this way, the second noise control algorithm may be optimized utilizing the first and second error microphone M3, M4.

In some implementations, one or more of the amplifiers A1, A2, A3 downstream of the microphones M1, M2, M2F may be tunable, in particular from the sending device SD. For example, a gain control signal is generated in the sending device SD based on at least the reconstructed first and second input signal and transmitted to the headset HS via the exchange line XL. The headset HS may adapt or tune an amplifier gain of at least one of the amplifiers A1, A2, A3 based on the transmitted gain control signal. Similarly, also a tuning of amplifiers A15 and A16 can be implemented, based on a respective control signal transmitted from the sending device SD. The adaptation of the amplifier gain can be performed during productive operation of the sending device SD and the headset HS, or during production, e.g. in an initial calibration.

This allows having calibrated microphone gains, which is useful if beamforming TX noise cancellation is desired. Similarly, also for RX noise cancellation well calibrated microphone gains can improve performance.

It is pointed out that implementations analog to the implementation of FIG. 5 may be readily derived based on the receiving noise control used in FIG. 3 instead of the receiving noise control used in FIG. 4.

Figure 6:
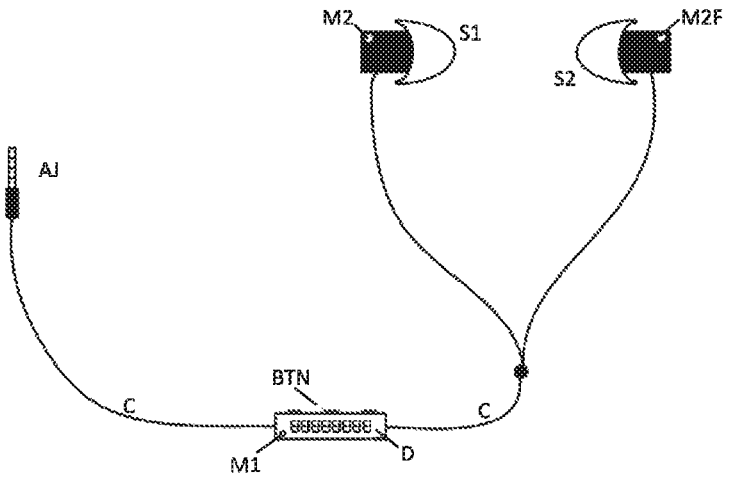
FIG. 6 shows an exemplary implementation of a headset for being used in system for transmission path noise control according to the improved concept.

FIG. 6 shows an exemplary implementation of a headset for being used in a system for transmission path noise control according to the improved concept, for example in the system as shown in FIG. 2.

The headset HS comprises a first earphone comprising the first speaker S1 and a second earphone comprising the second speaker S2. The display D is implemented in a dongle on the data cable C. The first microphone M1 and the control element BTN are also implemented in the dongle. The four pole audio jack AJ is implemented for example according to a tip-ring-ring-sleeve arrangement.

The second microphone M2 is arranged for example on a side of the first earphone opposite to a sound output side of the first speaker S1 and the further second microphone M2 is arranged for example on a side of the second earphone opposite to a sound output side of the second speaker S2.

In alternative implementations, the microphones may be positioned at different locations. The second microphones M2, M2F may for example also be located in the dongle or directly inside the earphones.

Implementations of the headset analog to the implementation of FIG. 6, in particular implementations without the display D, may for example be used in implementations of the system of FIGS. 1 and 3 to 5.

Figure 7:
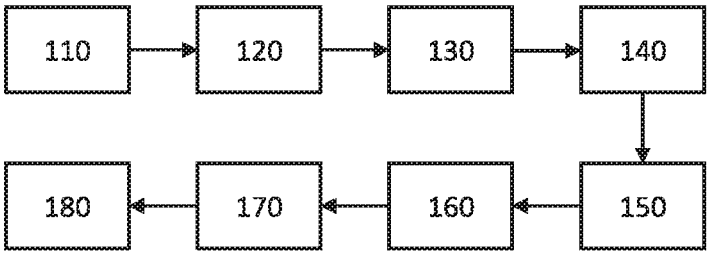
FIG. 7 shows a flowchart of a startup sequence of a method or system for transmission path noise control according to the improved concept.

FIG. 7 shows a flowchart of a startup sequence of a system or method for transmission path noise control according to the improved concept.

As explained with respect to FIG. 1, the headset HS of FIGS. 1 to 5 may operate with basic functionality, that is with the first and the second bypass switch S1, S2 being closed, if an alternative sending device that is not compatible with transmission path noise control is connected to the headset HS. Analogously, the sending device SD of FIGS. 1 to 5 may operate with basic functionality, that is with the third bypass switch S3 being closed, if an alternative headset that is not compatible with transmission path noise control is connected to the sending device SD.

Therefore, a startup sequence may be carried out by a system according to the improved concept when the headset HS is connected to the sending device SD. The blocks 110 to 180 of FIG. 7 represent such a startup sequence. The startup sequence may be used by a system according to the improved concept as explained with respect to one of FIGS. 1 to 5.

In block 110 the sending device SD detects that the headset HS is connected to the sending device SD via the data cable C. In block 120, the third bypass switch S3 is opened and the master circuit MS is for example powered up. In block 130, the master circuit MS sends a first identification signal to the slave circuit SL via the exchange line XL. In block 140, the slave circuit SL detects the first identification signal.

In block 150 the slave circuit SL is for example activated and sends a second identification signal to the master circuit MS via the exchange line XL. In block 160 the master circuit MS detects the second identification signal and establishes a bidirectional communication channel for communicating via the exchange line XL. In optional block 170, the slave circuit starts with a preamble to transfer user or device specific data are stored in the storage device MEM as described with respect to FIG. 1. In block 180 the slave circuit SL starts with the transmission of the encoded signal depending on the first and the second input signals and, if applicable on the control signal, as described for example with respect to FIG. 1.

In case an alternative sending device being not compatible with transmission path noise control is connected to the headset, the first identification signal is not detected by the headset HS. Consequently, the slave circuit SL may close the first bypass switch S1, and if applicable the second bypass switch S2. In case an alternative headset being not compatible with transmission path noise control is connected to the sending device SD, the second identification signal is not detected by the sending device SD. Consequently, the master circuit SL may close the third bypass switch S2.

It is noted that a frequency of the first and the second identification signal may lie within an audio band for example from 10 Hz to 22 kHz. Since the transmission of the first and the second identification signal is performed via the exchange line XL and in particular not via the first or the second audio line ALL AL2, the first and the second identification signal are not recognized by a user of the headset HS irrespective of the used frequency. Alternatively, the frequency of the first and the second identification signal may lie outside the audio band, for example above 22 kHz.

Further implementations of the headset HS, the sending device SD and/or the system according to the improved concept are readily derived by the skilled reader by combining two or more of the implementations described with respect to FIGS. 1 to 7 or by combining suitable parts of the various implementations described with respect to FIGS. 1 to 7. In particular, all components or groups of components of any implementation may be combined with any other implementation if no conflicting technical reasons exist.

By means of the described implementations of the system and the method according to the improved concept, transmission noise path control may be realized using an input device the headset HS connected to the sending device SD.

The improved concept provides improved speech intelligibility for the headset HS connected to the sending device SD with the capability of transmitting multiple microphone data channels to the master circuit MS. Furthermore, it is possible to authenticate headsets connected to a sending device and to change or customize for example equalizer settings when the headset HS is connected. These function are achieved with full legacy or downwards support. Thus, a transmission path noise control headset can be connected to a sending device being not capable of transmission path noise control and the user can still use the control element BTN as well as the first microphone M1.

With the downlink communication from slave circuit SL to master circuit MS, the display D may be used to show caller identification information or artist information while listening to music. Furthermore user specific data inside the headset HS may be updated. The user might give the headset HS a name and store its personal preferred equalizer settings directly to the storage device MEM.

With the uplink communication from master circuit MS to slave circuit SL and the power extraction unit PE also the adaptive active noise control circuit ANC may be placed directly in the headset HS. The active noise control circuit ANC may be adjusted from the sending device SD by using the error information.

The invention claimed is:

1. A method for transmission path noise control using an audio headset and a sending device connected to the headset via a data cable, the method comprising:

generating a first and a second microphone signal using a first and a second microphone of the headset, respectively, based on detected sound including desired audio information and acoustic noise;

generating an encoded signal by encoding at least a first input signal which depends on the first microphone signal and a second input signal which depends on the second microphone signal;

transmitting the encoded signal from the headset to the sending device via a first line of the data cable;

reconstructing, using the sending device, the first and the second input signal by decoding the encoded signal;

generating, using the sending device, a clean signal representing the desired audio information by applying a first noise control algorithm to at least the reconstructed first and second input signal;

sending a signal depending on the clean signal from the sending device to a communication network;

transmitting an audio signal from the sending device to the headset via a second line of the data cable;

generating a compensated audio signal by applying, within the headset, a second noise control algorithm at least to the audio signal and the second microphone signal;

generating, using a speaker of the headset, an acoustic speaker signal based on the compensated audio signal;

generating, in the sending device, a gain control signal based on at least the reconstructed first and second input signal;

transmitting the gain control signal from the sending device to the headset via the first line; and adapting an amplifier gain of at least one amplifier in the headset associated with the generation of the first and/or the second microphone signal based on the transmitted gain control signal.

2. The method according to claim 1, further comprising:

detecting, using a third microphone of the headset, a disturbed speaker signal depending on the speaker signal; and generating, using the third microphone, a third microphone signal based on the disturbed speaker signal, wherein the compensated audio signal is generated by applying the second noise control algorithm at least to the audio signal, the second microphone signal and the third microphone signal.

3. The method according to claim 2, wherein the encoded signal is generated by encoding at least the first and the second input signal and an error signal which depends on the third microphone signal, and wherein the method further comprises reconstructing the error signal based on the decoding of the encoded signal.

4. The method according to claim 3, further comprising adapting, using the sending device, the audio signal depending on the reconstructed error signal.

5. The method according to claim 3, further comprising:

generating, using the sending device, an adaption signal depending on the error signal;

transmitting a signal depending on the adaption signal from the sending device to the headset via the first line; and adapting, using the headset, the second noise control algorithm based on the signal depending on the adaption signal.

6. The method according to claim 1 further comprising:

generating a control signal using at least one control element of the headset, wherein the encoded signal is generated by encoding at least the first and the second input signal and the control signal; and reconstructing the control signal based on the decoding of the encoded signal.

7. The method according to claim 1 further comprising:

transmitting a data signal from the sending device to the headset via the first line; and displaying information on a display of the headset depending on the data signal.

8. The method according to claim 1 further comprising intermediately storing the clean signal or the signal depending on the clean signal before sending the signal depending on the clean signal to the communication network.

9. The method according to claim 1, wherein the adaptation of the amplifier gain is performed during productive operation of the sending device and the headset.

10. A method for transmission path noise control using an audio headset and a sending device connected to the headset via a data cable, the method comprising:

determining whether the headset and the sending device are both compatible with transmission path noise control based on at least one identification signal transmitted between the headset and the sending device via a first line of the data cable;

if the headset and the sending device are both compatible with transmission path noise control:

generating a first and a second microphone signal using a first and a second microphone of the headset, respectively, based on detected sound including desired audio information and acoustic noise;

generating an encoded signal by encoding at least a first input signal which depends on the first microphone signal and a second input signal which depends on the second microphone signal;

transmitting the encoded signal from the headset to the sending device via a first line of the data cable;

reconstructing, using the sending device, the first and the second input signal by decoding the encoded signal;

generating, using the sending device, a clean signal representing the desired audio information by applying a first noise control algorithm to at least the reconstructed first and second input signal;

sending a signal depending on the clean signal from the sending device to a communication network;

transmitting an audio signal from the sending device to the headset via a second line of the data cable;

generating a compensated audio signal by applying, within the headset, a second noise control algorithm at least to the audio signal and the second microphone signal; and generating using a speaker of the headset an acoustic speaker signal based on the compensated audio signal;

if the headset or the sending device is not compatible with transmission path noise control:

generating the first microphone signal using the first microphone;

transmitting the first microphone signal from the headset to the sending device via the first line of the data cable; and sending a signal depending on the first microphone signal from the sending device to a communication network.

11. A system for transmission path noise control comprising an audio headset and a sending device connectable to the headset via a data cable, wherein the headset comprises:

a first and a second microphone configured to generate a first and a second microphone signal, respectively, based on detected sound including desired audio information and acoustic noise;

an encoder configured to generate an encoded signal on a first line of the data cable by encoding at least a first input signal which depends on the first microphone signal and a second input signal which depends on the second microphone signal;

an active noise control circuit configured to generate a compensated audio signal by applying a second noise control algorithm at least to an audio signal, which is provided on a second line of the data cable, and the second microphone signal; and a speaker configured to generate an acoustic speaker signal depending on the compensated audio signal; and wherein the sending device comprises:

a decoder configured to reconstruct the first and the second input signal by decoding the encoded signal;

a signal processing unit configured to generate a clean signal representing the desired audio information by applying a first noise control algorithm to at least the reconstructed first and second input signal;

a network unit configured to send a signal depending on the clean signal to a communication network; and an audio codec circuit configured to generate the audio signal on the second line of the data cable, wherein the sending device is configured for generating a gain control signal based on at least the reconstructed first and second input signal and for transmitting the gain control signal to the headset via the first line, and wherein the headset comprises at least one tunable amplifier connected to the first and/or the second microphone and is configured for adapting an amplifier gain of the at least one amplifier based on the transmitted gain control signal.

12. The system according to claim 11, wherein:

the headset further comprises a third microphone configured to detect a disturbed speaker signal depending on the speaker signal and to generate a third microphone signal depending on the disturbed speaker signal; and the active noise control circuit is configured to generate the compensated audio signal by applying the second noise control algorithm at least to the audio signal, the second microphone signal and the third microphone signal.

13. The system according to claim 12, wherein:

the encoder is configured to generate the encoded signal by encoding at least the first and the second input signal and an error signal which depends on the third microphone signal; and the decoder is configured to reconstruct the error signal using the decoding of the encoded signal.

14. The system according to claim 13, wherein:

the sending device further comprises an application processor configured to generate a digital audio signal;

the audio codec circuit is configured to generate the audio signal based on the digital audio signal; and the application processor is configured to adapt the digital audio signal depending on the reconstructed error signal.

15. The system according to claim 13, wherein:

the sending device is configured for generating an adaption signal depending on the error signal and for transmitting a signal depending on the adaption signal to the headset via the first line; and the headset is configured for adapting the second noise control algorithm based on the signal depending on the adaption signal.

16. The system according to claim 11, wherein the headset is configured for displaying information on a display of the headset depending on a data signal received from the sending device via the first line.

17. The system according to claim 11, wherein the system is configured for performing the adaptation of the amplifier gain during productive operation of the sending device and the headset.

* * * * *